US006003610A

United States Patent [19]

Kordes

[11] Patent Number: 6,003,610

[45] Date of Patent: Dec. 21, 1999

[54] FIRE EXTINQUISHING SYSTEM FOR A CHRISTMAS TREE

[76] Inventor: Michael John Kordes, 472 Mantoloking Rd., Brick, N.J. 08723

[21] Appl. No.: 09/024,189

[22] Filed: Feb. 17, 1998

[51] Int. Cl.[6] ..... A62C 37/10

[52] U.S. Cl. ..... 169/61

[58] Field of Search ..... 169/13, 11, 54, 169/56, 61, 68, 30

[56] References Cited

U.S. PATENT DOCUMENTS

| | | | |
|---|---|---|---|
| 3,713,491 | 1/1973 | Grabowski | 169/54 |
| 3,783,946 | 1/1974 | Petrinec et al. | 169/11 |
| 4,068,118 | 1/1978 | Carrington | 362/123 |
| 5,018,586 | 5/1991 | Cawley et al. | 169/61 |
| 5,031,702 | 7/1991 | Trumbach | 169/61 |
| 5,243,782 | 9/1993 | Jones | 47/40.5 |

*Primary Examiner*—Kevin Weldon

[57] ABSTRACT

A fire extinguishing system for a Christmas tree including a hollow base for maintaining a tree in a vertical orientation. Further provided is a pair of linear rigid lower extinguisher tubes. At least one flexible extinguisher tube is also included with a lower end and an upper end positioned adjacent a top end of the Christmas tree, wherein an intermediate extent of each flexible extinguisher is wrapped about the trunk of the Christmas tree. Further provided is at least one fire extinguisher situated within the interior space of the base containing fire extinguishing material. The fire extinguisher is connected to the extinguisher tubes and is adapted to excrete the fire extinguishing material through out the Christmas tree upon the actuation thereof. Such actuation is afforded via a fire sensor electrically connected to a power supply and the fire extinguisher for effecting the activation of the fire extinguisher upon the detection of a temperature above a predetermined amount.

7 Claims, 4 Drawing Sheets

FIRE EXTINQUISHING SYSTEM FOR A CHRISTMAS TREE

BACKGROUND OF THE INVENTION

1. Field of the Invention

The present invention relates to a fire extinguishing system for a Christmas tree and more particularly pertains to automatically dispersing fire extinguishing material throughout a Christmas tree upon the detection of fire.

2. Description of the Prior Art

The use of fire extinguishers is known in the prior art. More specifically, fire extinguishers heretofore devised and utilized for the purpose of for extinguishing various fires are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,031,702 to Trumbach; U.S. Pat. No. 5,018,586 to Cawley et al.; U.S. Pat. Des. 352,366 to Cox; U.S. Pat. No. 4,709,763 to Jessick; U.S. Pat. No. 4,113,020 to Panetta; and U.S. Pat. No. 4,623,878 to Schoenwetter.

In this respect, the fire extinguishing system for a Christmas tree according to the present invention substantially departs from the conventional concepts and designs of the prior art, and in so doing provides an apparatus primarily developed for the purpose of automatically dispersing fire extinguishing material throughout a Christmas tree upon the detection of fire.

Therefore, it can be appreciated that there exists a continuing need for a new and improved fire extinguishing system for a Christmas tree which can be used for automatically dispersing fire extinguishing material throughout a Christmas tree upon the detection of fire. In this regard, the present invention substantially fulfills this need.

SUMMARY OF THE INVENTION

In view of the foregoing disadvantages inherent in the known types of fire extinguishers now present in the prior art, the present invention provides an improved fire extinguishing system for a Christmas tree. As such, the general purpose of the present invention, which will be described subsequently in greater detail, is to provide a new and improved fire extinguishing system for a Christmas tree which has all the advantages of the prior art and none of the disadvantages.

To attain this, the present invention essentially comprises a base having a lower extent with a frusto-conical configuration. The lower extent has a top face, a lower face, and a downwardly sloping periphery defining an interior space. The lower extent of the base further has a vertically oriented bore formed therein between the top face and the bottom face. The bore has an open top, a closed bottom, and a closed periphery. As best shown in FIG. 2, the base also has an upper extent formed of a tube integrally formed on the top face of the lower extent. The tube has a hollow interior which resides in coaxial relationship with the bore of the lower extent. A plurality of threaded apertures are radially positioned on a periphery thereof. The tube and the periphery of the bore both have a plurality of vertically oriented conduits each with a top open end situated on an upper edge of the tube and a lower open end formed in the periphery of the bore within the interior space of the base. Also shown in FIG. 2, the base further has a transparent strip located on the periphery thereof for affording a view of the interior space thereof. Further provided is a plurality of tree trunk stabilizer pins formed of a gripping circular portion with a threaded portion integrally coupled thereto. Such threaded portion is adapted for screwably engaging the threaded apertures of the tube thereby maintaining a tree trunk of a Christmas tree in a vertical orientation within the interior of the tube and within the bore. As shown in FIG. 1, a pair of linear rigid lower extinguisher tubes are included each having a vertical orientation. Each linear rigid tubes has a first open end coupled to the top open ends of a pair of diametrically opposed conduits of the base and a second end extended upwardly. Associated therewith is a pair of flexible extinguisher tubes each having a lower end coupled to the top open ends of another pair of diametrically opposed conduits of the base. Each flexible extinguisher tube also has an upper end positioned adjacent a top end of the Christmas tree, wherein an intermediate extent of each flexible extinguisher is wrapped about the trunk of the Christmas tree. Also included is a cone having an open bottom and a plurality of stanchions integrally and perpendicularly coupled to an inner surface of the cone. Such stanchions are further extended inwardly and downwardly to frictionally engage the top end of the trunk of the Christmas tree. In use, the second ends of the flexible extinguisher tubes are directed towards an upper interior surface of the cone. For containing fire extinguishing material, a pair of fire extinguishers are situated within the interior space of the base. See FIG. 3. Each fire extinguisher has a gauge situated beneath the transparent strip of the base for determining the status of the fire extinguishing material. An outlet of each fire extinguisher is connected to the lower ends of the conduits. In operation, the fire extinguishers are adapted to excrete the fire extinguishing material from the outlet upon the actuation thereof. Finally, a heat sensor is situated within the interior space of the base and electrically connected to a power supply and the fire extinguishers. Upon the detection of a temperature above a predetermined amount, the heat sensor is adapted for effecting the activation of the fire extinguisher.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved fire extinguishing system for a Christmas tree which has all the advantages of the prior art fire extinguishers and none of the disadvantages.

It is another object of the present invention to provide a new and improved fire extinguishing system for a Christmas tree which may be easily and efficiently manufactured and marketed.

It is a further object of the present invention to provide a new and improved fire extinguishing system for a Christmas tree which is of a durable and reliable construction.

An even further object of the present invention is to provide a new and improved fire extinguishing system for a Christmas tree which is susceptible of a low cost of manufacture with regard to both materials and labor, and which accordingly is then susceptible of low prices of sale to the consuming public, thereby making such fire extinguishing system for a Christmas tree economically available to the buying public.

Still yet another object of the present invention is to provide a new and improved fire extinguishing system for a Christmas tree which provides in the apparatuses and methods of the prior art some of the advantages thereof, while simultaneously overcoming some of the disadvantages normally associated therewith.

Still another object of the present invention is to automatically disperse fire extinguishing material throughout a Christmas tree upon the detection of fire.

Lastly, it is an object of the present invention to provide a new and improved fire extinguishing system for a Christmas tree including a hollow base for maintaining a tree in a vertical orientation. Further provided is a pair of linear rigid lower extinguisher tubes. At least one flexible extinguisher tube is also included with a lower end and an upper end positioned adjacent a top end of the Christmas tree, wherein an intermediate extent of each flexible extinguisher is wrapped about the trunk of the Christmas tree. Further provided is at least one fire extinguisher situated within the interior space of the base containing fire extinguishing material. The fire extinguisher is connected to the extinguisher tubes and is adapted to excrete the fire extinguishing material through out the Christmas tree upon the actuation thereof. Such actuation is afforded via a fire sensor electrically connected to a power supply and the fire extinguisher for effecting the activation of the fire extinguisher upon the detection of a temperature above a predetermined amount.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
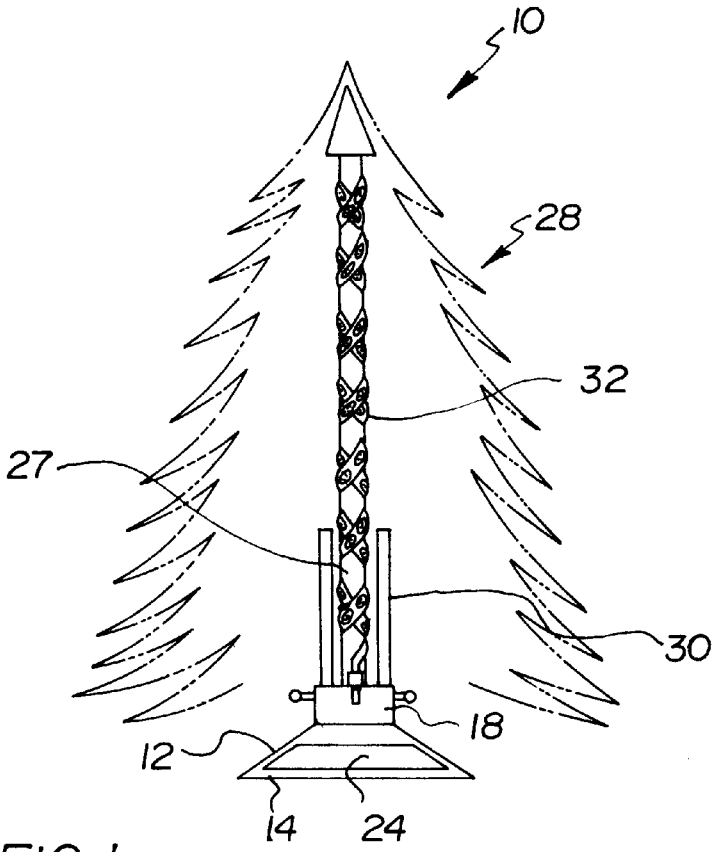
FIG. 1 is a perspective illustration of the preferred embodiment of the fire extinguishing system for a Christmas tree constructed in accordance with the principles of the present invention.

With reference now to the drawings, and in particular to FIG. 1 thereof, a new and improved fire extinguishing system for a Christmas tree embodying the principles and concepts of the present invention and generally designated by the reference numeral 10 will be described.

The present invention, the new and improved fire extinguishing system for a Christmas tree, is comprised of a plurality of components. Such components in their broadest context include a base, a plurality of extinguisher tubes, a cone, a plurality of fire extinguishers, and a heat sensor. Such components are individually configured and correlated with respect to each other so as to attain the desired objective.

Figure 2:
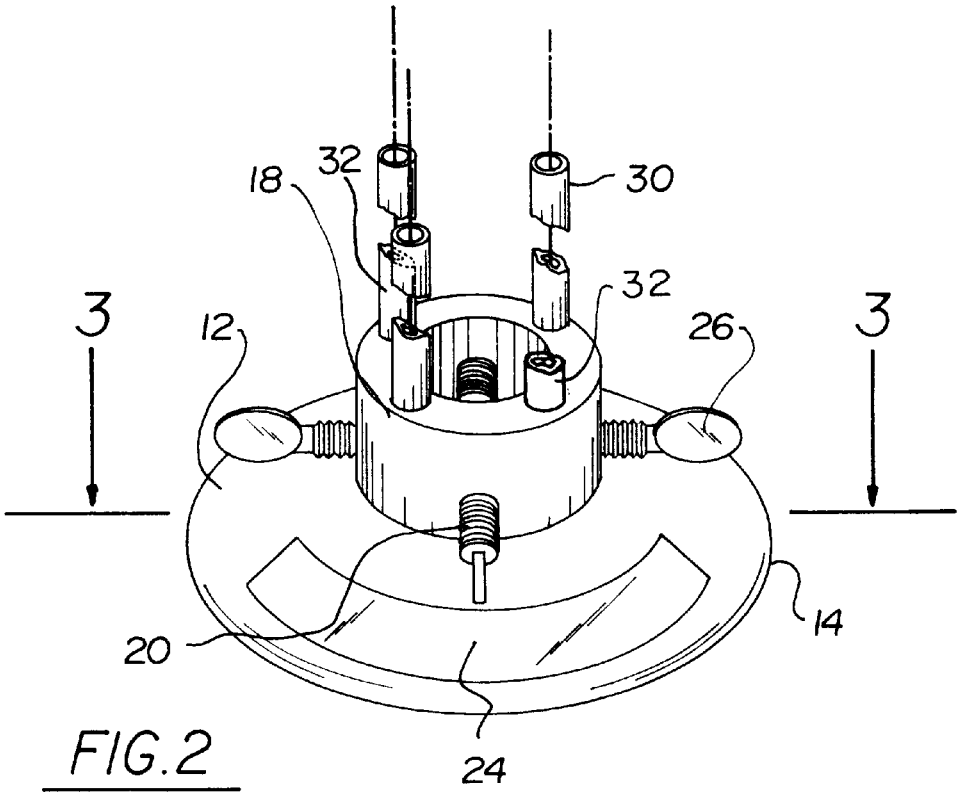
FIG. 2 is a perspective view of the base of the present invention.

More specifically, it will be noted that the system 10 of the present invention includes a base formed of a flame resistant sturdy rubberized material 12 having a lower extent 14 with a frusto-conical configuration. In the preferred embodiment, the base along with the remaining components of the present invention are constructed from sturdy rubberized material that is both shatter-proof and child-safe. The lower extent has a top face, a lower face, and a downwardly sloping periphery defining an interior space. The lower extent of the base further has a vertically oriented bore 16 formed therein between the top face and the bottom face. The bore has an open top, a closed bottom, and a closed periphery. As best shown in FIG. 2, the base also has an upper extent 18 formed of a tube integrally formed on the top face of the lower extent. The tube has a hollow interior which resides in coaxial relationship with the bore of the lower extent. A plurality of threaded apertures 20 are radially positioned on a periphery thereof. The tube and the periphery of the bore both have a plurality of vertically oriented conduits 22 each with a top open end situated on an upper edge of the tube and a lower open end formed in the periphery of the bore within the interior space of the base. Also shown in FIG. 2, the base further has a transparent strip 24 located on the periphery thereof for affording a view of the interior space thereof. Further provided is four tree trunk stabilizer pins 26 formed of a gripping circular portion with a threaded portion integrally coupled thereto. Such threaded portion is adapted for screwably engaging the threaded apertures of the tube thereby maintaining a tree trunk 27 of a Christmas tree 28 in a vertical orientation within the interior of the tube and within the bore.

Figure 4:
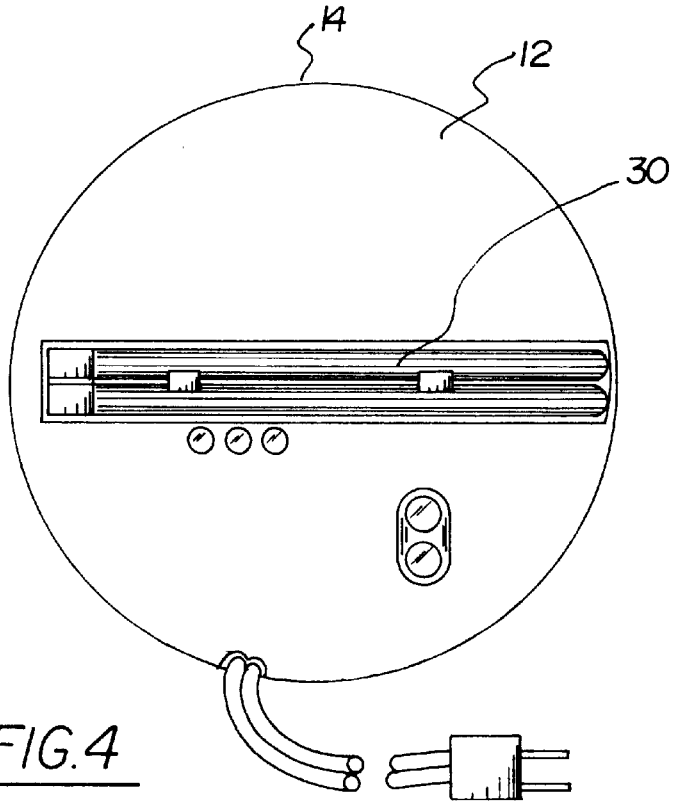
FIG. 4 is a bottom view of the present invention.
Figure 5:
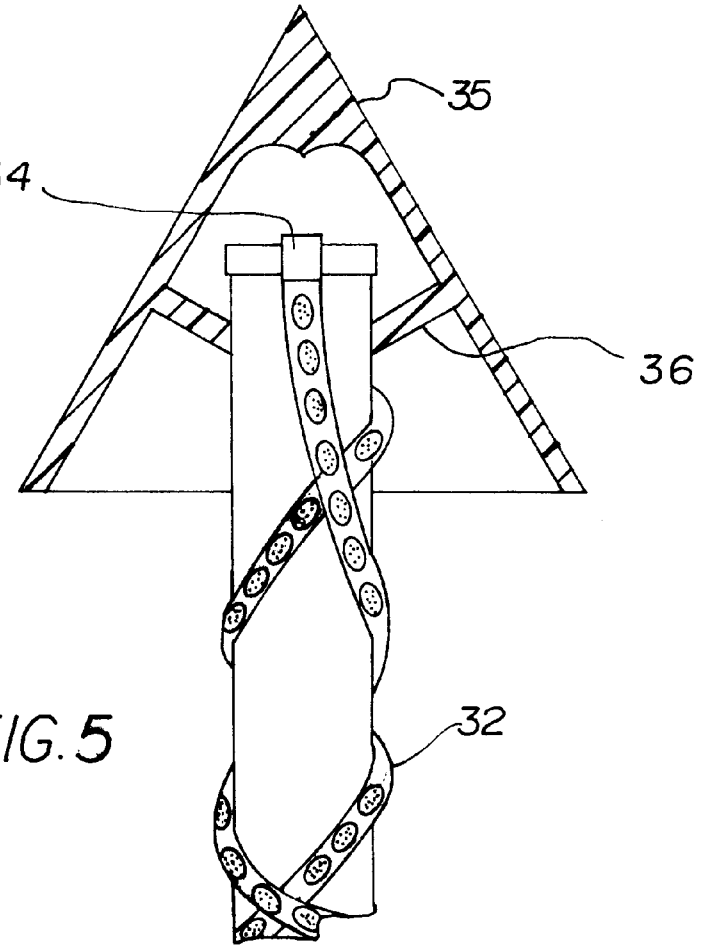
FIG. 5 is a cross-sectional view of the cone of the present invention.
Figure 6:
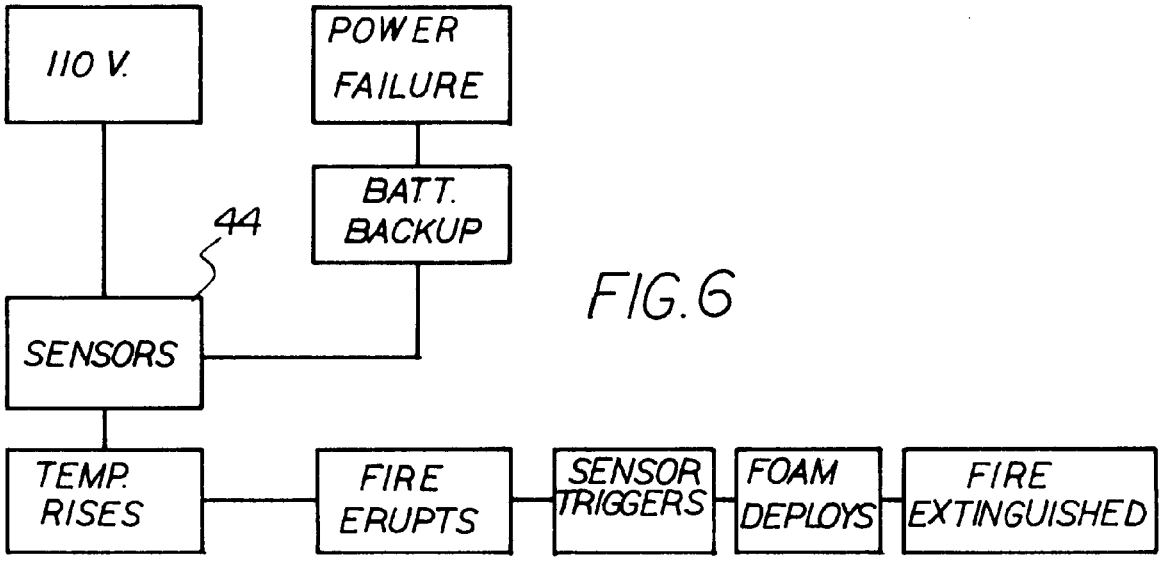
FIG. 6 is a flowchart/schematic of the various components of the present invention.

As shown in FIG. 1, a pair of linear rigid lower extinguisher tubes 30 are included each having a vertical orientation. Each of the extinguisher tubes has a first open end releasably coupled to the top open end of a pair of diametrically opposed conduits of the base and a second end extended upwardly. Preferably, the lower extinguisher tubes extend upwardly approximately ¼ the height of the Christmas tree. When the present invention is not being utilized, the lower extinguisher tubes may be situated within recesses formed in the bottom face of the housing, as shown in FIG. 4.

Associated therewith is a pair of flexible extinguisher tubes 32 each having a lower end coupled to the top open ends of another pair of diametrically opposed conduits of the base. Alternately, such conduits are equipped with a one-way valve. Each flexible extinguisher tube also has an upper end 34 positioned adjacent a top end of the Christmas tree, wherein an intermediate extent of each flexible extinguisher is wrapped about the trunk of the Christmas tree at least six times. As an option, the flexible tubes may include a multiplicity of circular regions with perforations formed therein for allowing the tube to be semi-permeable.

Also included is a cone 35 having an open bottom and a plurality of stanchions 36 integrally and perpendicularly coupled to an inner surface thereof. Preferably, the inner surface of the cone is formed at a 60 degree angle below a horizontal. Such stanchions are further extended inwardly and downwardly to frictionally engage the top end of the trunk of the Christmas tree. In use, the second ends of the flexible extinguisher tubes are directed towards an upper interior surface of the cone. Ideally, the upper interior surface has a pair of U-shaped cut outs for properly directing fluid as will become apparent hereinafter. As an option, the cone may be equipped with an ornament or the like to enhance the aesthetic nature of the present invention.

Figure 3:
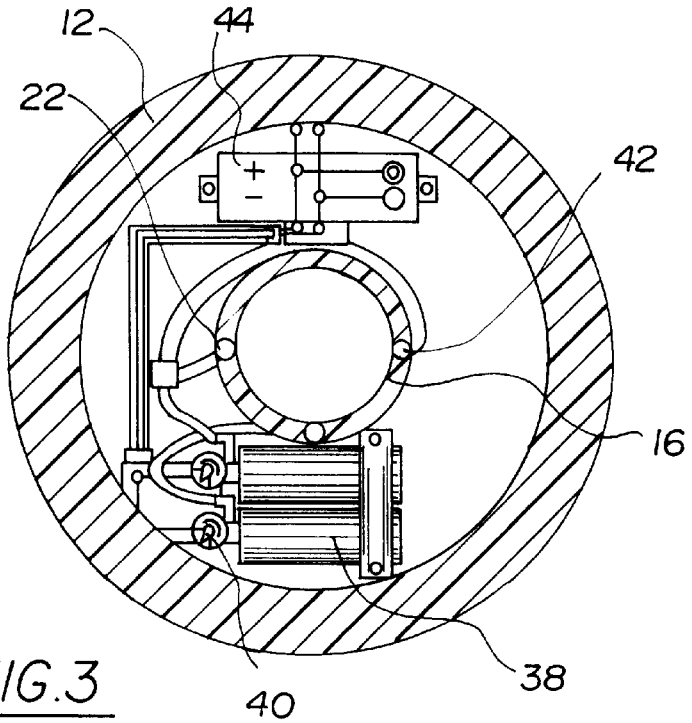
FIG. 3 is a cross-sectional view of the present invention taken along line 3—3 shown in FIG. 2.

For containing fire extinguishing material, a pair of fire extinguishers 38 are situated within the interior space of the base. See FIG. 3. Each fire extinguisher has a gauge 40 situated beneath the transparent strip of the base for determining the status of the fire extinguishing material. An outlet 42 of each fire extinguisher is connected to the lower ends of the conduits. In operation, the fire extinguishers are adapted to excrete the fire extinguishing material from the outlet upon the actuation thereof. In an alternate embodiment, a valve is included to ensure only one-way excretion of the fire extinguishing material.

Finally, a heat sensor 44 is situated within the interior space of the base and electrically connected to a power supply and the fire extinguishers. Upon the detection of a temperature above a predetermined amount, the heat sensor is adapted for effecting the activation of the fire extinguishers. For powering purposes, the present invention is equipped with a plug for connecting with a conventional receptacle. If such power supply is defective for some reason, a rechargeable battery is capable maintaining the present invention operable for up to five hours.

Figure 7:
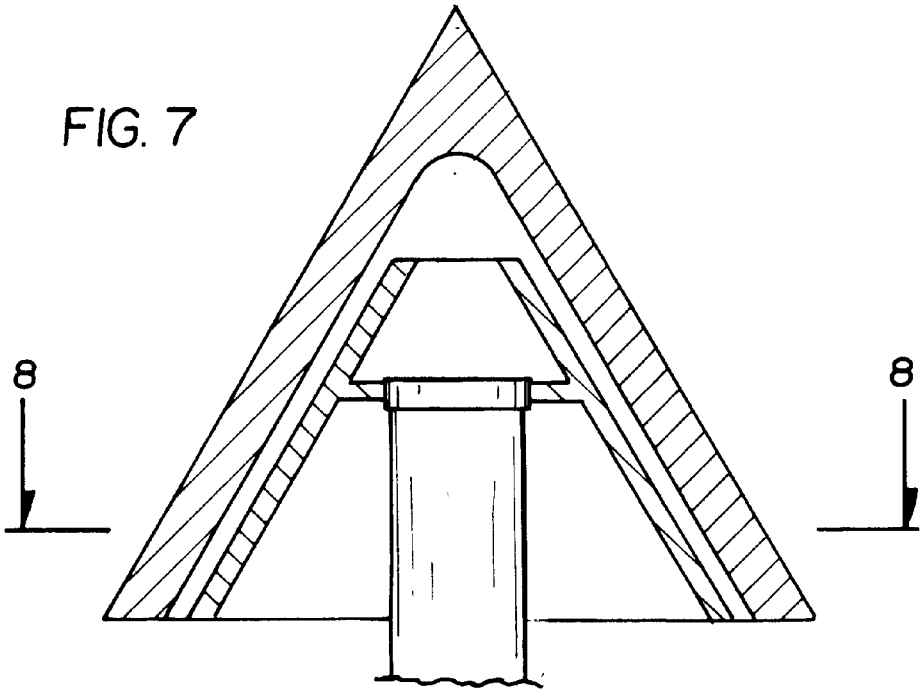
FIG. 7 is a cross-sectional view of an alternate design of the cone of the present invention.
Figure 8:
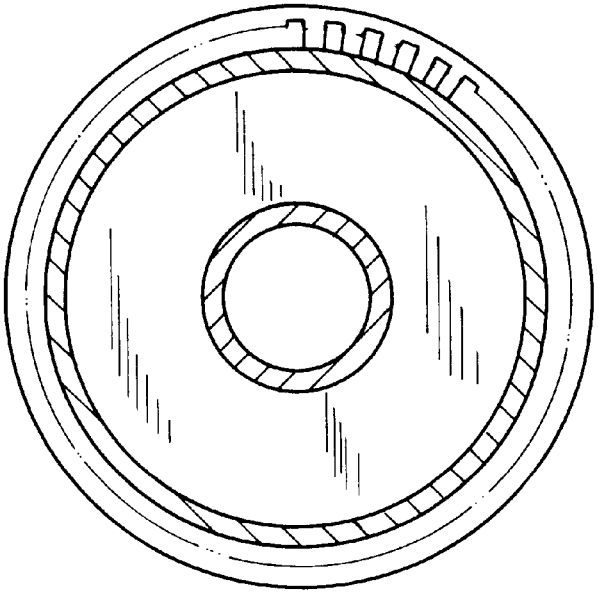
FIG. 8 is a bottom view of the cone shown in FIG. 7.

In an alternate embodiment, the cone is defined by a lower layer 50 and an upper layer 52. Note FIGS. 7 & 8. The lower layer has an open top and an open bottom. A plurality of stanchions are coupled to an inner surface of the lower layer to engage the top end of the trunk of the Christmas tree. While not shown, the second ends of the flexible extinguisher tubes are directed towards an upper interior surface of the lower layer of the cone, similar to the previous embodiment. The upper layer of the cone includes an open bottom, a closed top and an interior surface lined with a plurality of vertically extending grooves 54. As best shown in FIG. 8, each groove is equipped with an apex 56 which is coupled to an outer surface of the lower layer of the cone thus defining a plurality of channels 58 between the lower layer and upper layer. Such channels are adapted for guiding the fire extinguishing material from the tubes downwardly and outwardly throughout the tree in an evenly dispersed manner.

In use upon the activation of the fire extinguisher, the fire extinguishing material is sprayed downwardly and outwardly from the top end of the Christmas tree. Such fire extinguishing material is further sprayed upwardly from a lower extent of the tree adjacent the trunk thereof.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved fire extinguishing system for a Christmas tree comprising, in combination:

a base having a lower extent in a frusto-conical configuration with a top face, a lower face, and a downwardly sloping periphery defining an interior space, the lower extent having a vertically oriented bore formed therein between the top face and the bottom face with an open top, a closed bottom, and a closed periphery, the base further having an upper extent formed of a tube integrally formed on the top face of the lower extent with a hollow interior thereof in coaxial relationship with the vertically oriented bore formed in the lower extent and having a periphery with a plurality of threaded apertures radially positioned on the periphery, the tube and the periphery of the bore having a plurality of vertically oriented conduits each with a top open end situated on an upper edge of the tube and a lower open end formed in the periphery of the bore within the interior space of the base, the base further having a transparent strip located on the periphery thereof for affording a view of the interior space thereof and a plurality of tree trunk stabilizer pins formed of a gripping circular portion with a threaded portion integrally coupled thereto for screwably engaging the threaded apertures of the tube for maintaining a Christmas tree in a vertical orientation within the interior of the tube and within the bore;

a pair of linear rigid lower extinguisher tubes each having a vertical orientation with a first open end coupled to the top open ends of a pair of diametrically opposed conduits of the base and a second end extended upwardly;

a pair of flexible extinguisher tubes each having a lower end coupled to the top open ends of another pair of diametrically opposed conduits of the base and an upper end positioned adjacent a top end of the Christmas tree, wherein an intermediate extent of each flexible extinguisher is wrapped about the trunk of the Christmas tree;

a cone having an open bottom, a plurality of stanchions integrally and perpendicularly coupled to an inner surface of the cone and further extending inwardly and downwardly to frictionally engage the top end of the trunk of the Christmas tree, wherein the second ends of the flexible extinguisher tubes are directed towards an upper interior surface of the cone;

a pair of fire extinguishers situated within the interior space of the base containing fire extinguishing material and an outlet connected to the lower ends of the conduits, the fire extinguisher adapted to excrete the fire extinguishing material from the outlet upon the actuation thereof; and a heat sensor situated within the interior space of the base and electrically connected to a power supply and the fire extinguisher for effecting the activation of the fire extinguisher upon the detection of a temperature above a predetermined amount;

whereby upon the activation of the fire extinguisher, the fire extinguishing material is sprayed downwardly and outwardly from the top end of the Christmas tree and further sprayed upwardly from a lower extent of the tree adjacent the trunk thereof.

2. A fire extinguishing system for a Christmas tree comprising:

a hollow base for maintaining a tree in a vertical orientation, the base comprising a lower extent in a frusto-conical configuration with a top face, a lower face, and a downwardly sloping periphery defining a interior space, the lower extent having a vertically oriented bore formed therein between the top face and the bottom face with an open top, a closed bottom, and a closed periphery, the base further having an upper extent formed of a tube integrally formed on the top face of the lower extent with a hollow interior thereof in coaxial relationship with the vertically oriented bore formed in the lower extent and having a periphery with a plurality of threaded apertures radially positioned on the periphery, the tube and the periphery of the bore having a plurality of vertically oriented conduits each with a top open end situated on an upper edge of the tube and a lower open end formed in the periphery of the bore within the interior space of the base, the base further having a plurality of tree trunk stabilizer pins formed of a gripping circular portion with a threaded portion integrally coupled thereto for screwably engaging the threaded apertures of the tube for maintaining a Christmas tree in a vertical orientation within the interior of the tube and within the bore;

a plurality of rigid lower extinguisher tubes;

at least one fire extinguisher situated within an interior space of the base containing fire extinguishing material, the fire extinguisher connected to the lower extinguisher tubes, the fire extinguisher adapted to excrete the fire extinguishing material though out the rigid lower extinguisher tubes upon the actuation of a fire extinguisher; and fire sensor means electrically connected to a power supply and the fire extinguisher for effecting the activation of the fire extinguisher upon the detection of a fire.

3. A fire extinguishing system for a Christmas tree as set forth in claim 2 wherein the fire sensor is situated within the interior space of the base and activates the fire extinguisher upon the detection of heat above a predetermined temperature.

4. A fire extinguishing system for a Christmas tree as set forth in claim 2 wherein the base further comprises a transparent strip located on the periphery thereof for affording a view of the interior space thereof and the fire extinguisher has a gauge situated beneath the transparent strip of the base for determining the status of the fire extinguishing material.

5. A fire extinguishing system for a Christmas tree as set forth in claim 2 and further comprising a pair of flexible extinguisher tubes each having a lower end coupled to the outlet of the fire extinguisher and an upper end positioned adjacent a top end of the Christmas tree, wherein an intermediate extent of each flexible extinguisher is wrapped about the trunk of the Christmas tree.

6. A fire extinguishing system for a Christmas tree as set forth in claim 5 and further comprising a cone having an open bottom, a plurality of stanchions integrally and perpendicularly coupled to an inner surface of the cone and further extending inwardly and downwardly to frictionally engage the top end of the trunk of the Christmas tree, wherein the second ends of the flexible extinguisher tubes are directed towards an upper interior surface of the cone.

7. A fire extinguishing system for a Christmas tree as set forth in claim 5 and further comprising a cone with a lower layer having an open top and an open bottom, a plurality of stanchions coupled to an inner surface of the lower layer to engage the top end of the trunk of the Christmas tree, wherein the second ends of the flexible extinguisher tubes are directed towards an upper interior surface of the lower layer of the cone, the cone further including an upper layer, the upper layer having an open bottom, a closed top and an interior surface lined with a plurality of vertically extending grooves each with an apex which is coupled to an outer surface of the lower layer of the cone thus defining a plurality of channels between the lower layer and upper layer of the cone for guiding the fire extinguishing material from the tubes downwardly and outwardly throughout the tree.

* * * * *